US005501356A

United States Patent [19]

Billingham

[11] Patent Number: 5,501,356

[45] Date of Patent: Mar. 26, 1996

[54] FILE BOX CLOSURE CATCH

[76] Inventor: Paul R. Billingham, 22 Heathfield Terrace, Chiswick, London W4 4JE, England

[21] Appl. No.: 122,404

[22] PCT Filed: Mar. 20, 1992

[86] PCT No.: PCT/GB92/00510

§ 371 Date: Sep. 27, 1993

§ 102(e) Date: Sep. 27, 1993

[87] PCT Pub. No.: WO92/17672

PCT Pub. Date: Oct. 15, 1992

[30] Foreign Application Priority Data

Mar. 28, 1991 [GB] United Kingdom ..... 9106666

[51] Int. Cl.[6] ..... B65D 45/16

[52] U.S. Cl. ..... 220/324; 292/87

[58] Field of Search ..... 220/4.23, 4.22, 220/324; 292/81, 80, 87, 209

[56] References Cited

U.S. PATENT DOCUMENTS

| | | | |
|---|---|---|---|
| 1,957,141 | 5/1934 | Jordan | 292/87 |
| 2,358,607 | 9/1944 | Tinnerman | 292/87 |
| 2,682,423 | 6/1954 | Ashworth | 292/87 |
| 3,313,564 | 4/1967 | Pultz | 292/87 |
| 4,371,092 | 2/1983 | Teague | 220/324 |
| 4,964,661 | 10/1990 | Cadwell et al. | 292/87 |
| 5,031,791 | 7/1991 | Serio, Jr. | 220/324 |
| 5,158,329 | 10/1992 | Schlack | 292/87 |

*Primary Examiner*—David T. Fidei

*Attorney, Agent, or Firm*—Fay, Sharpe, Beall, Fagan, Minnich & McKee

[57] ABSTRACT

A closure catch of resilient plastics material comprising two co-operating body parts (124, 126) adapted to fit onto the edges of the lid and sidewalls of a box file to hold it closed. The first member (124) carries an outwardly facing projection (160) which is engaged by a corresponding inwardly-facing projection (162) on a tongue (138) of the second member (126) which fits into the recess and has an actuating member (164) for opening the catch. The part (124) may also carry an inwardly projecting retaining member (128) to releasably retain an insert (130) in the box, for example a concertina file.

14 Claims, 6 Drawing Sheets

FIG. 1.
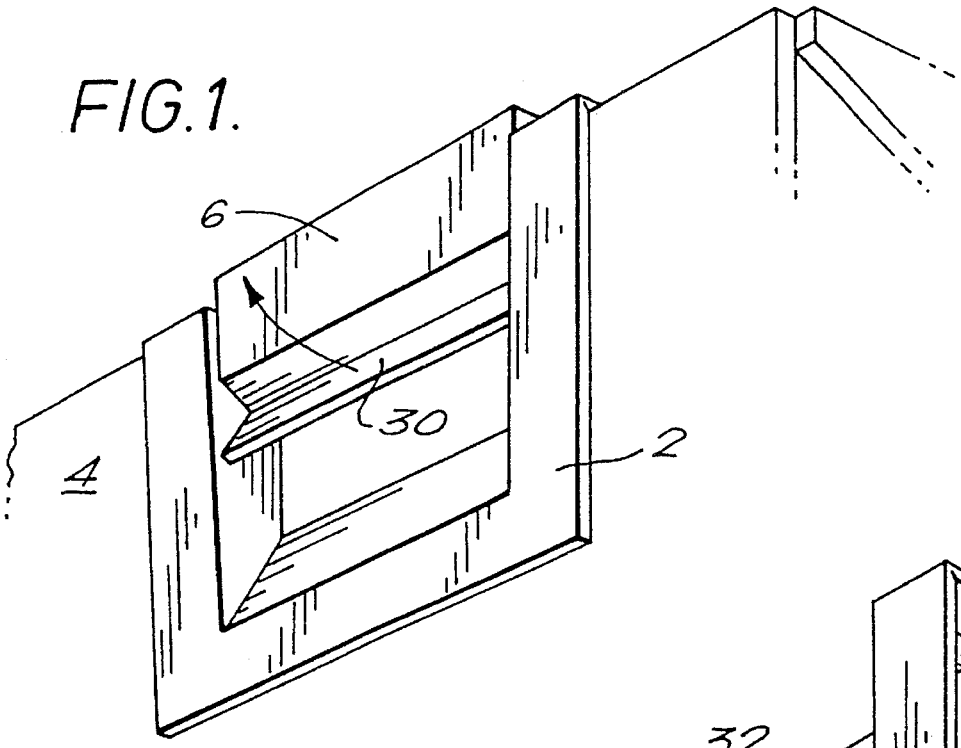
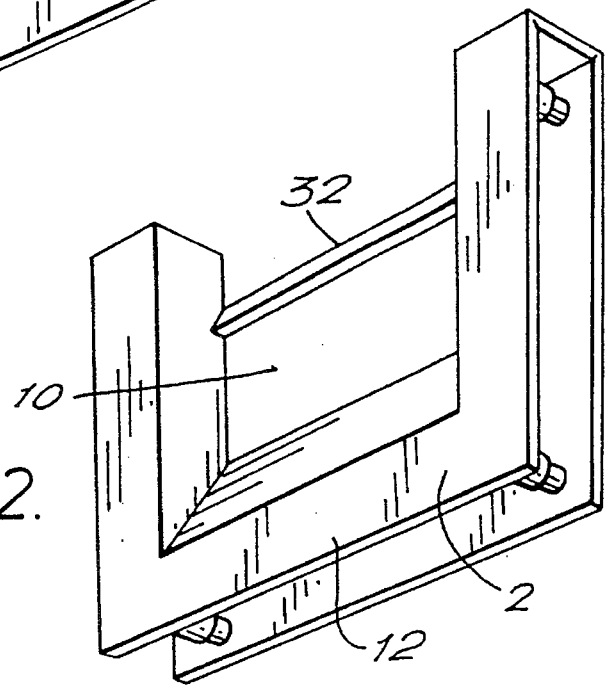
FIG. 2.
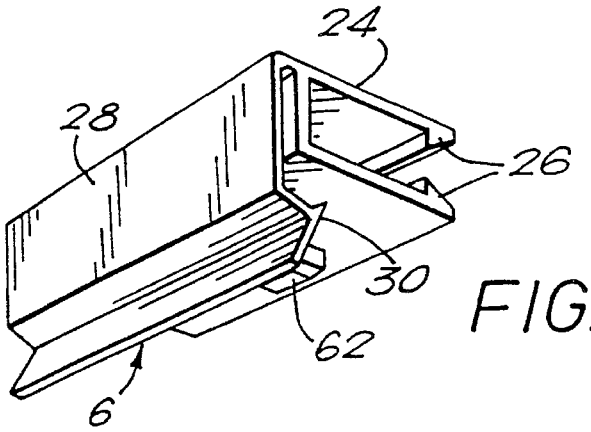
FIG. 3.

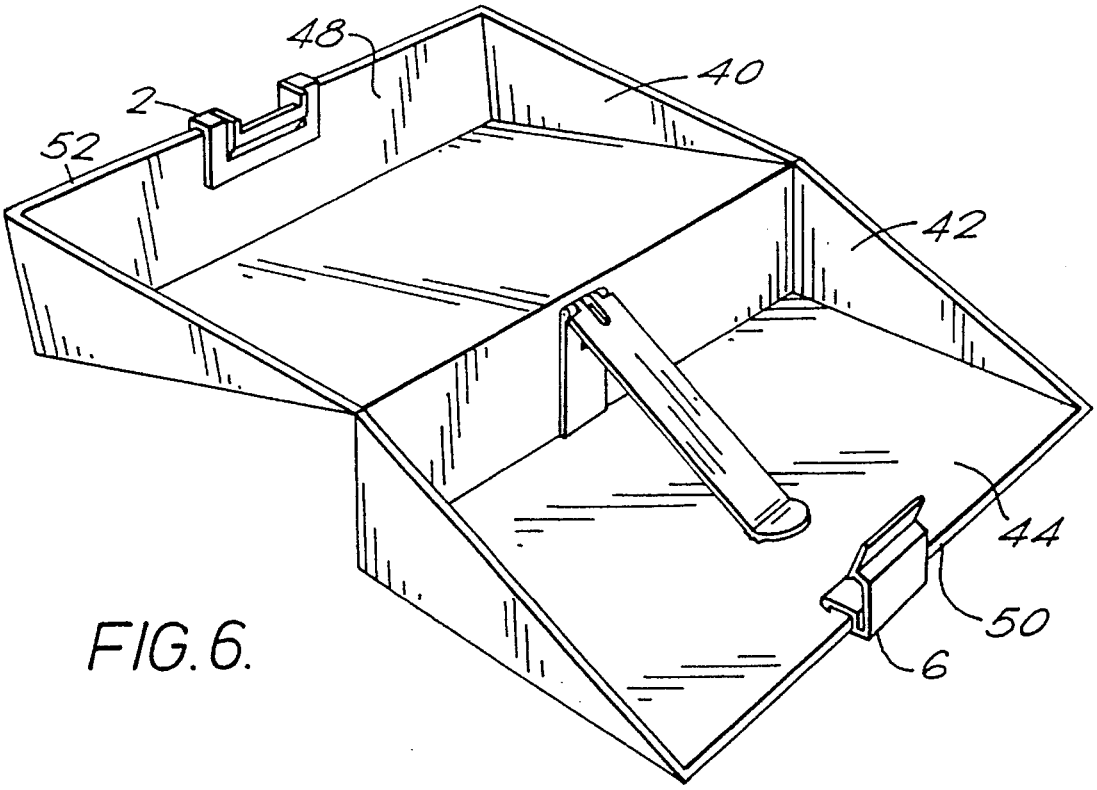
FIG. 6.
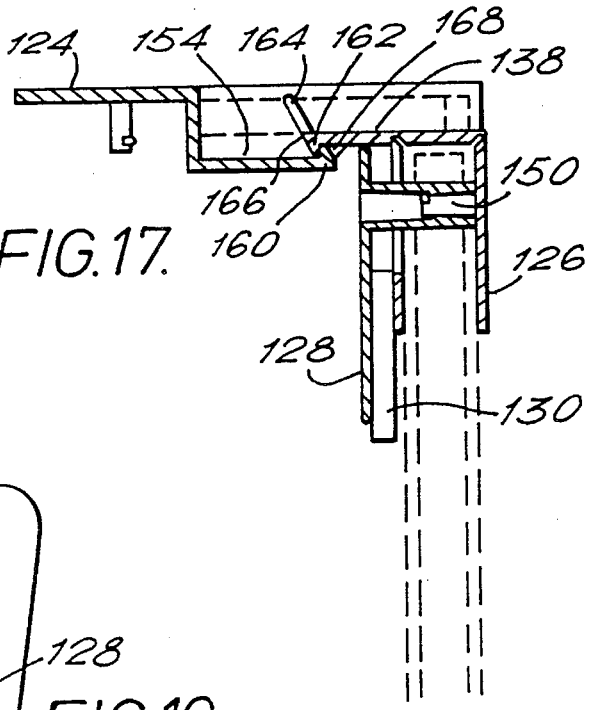
FIG. 17.
FIG. 18.
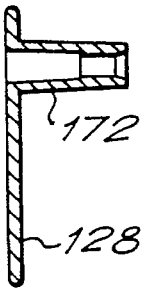
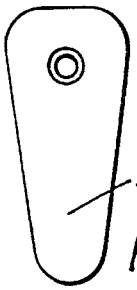
FIG. 19.

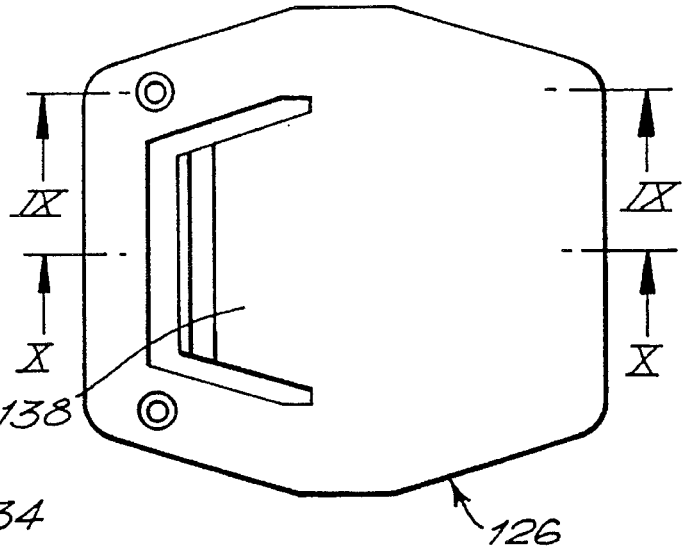
FIG.7.
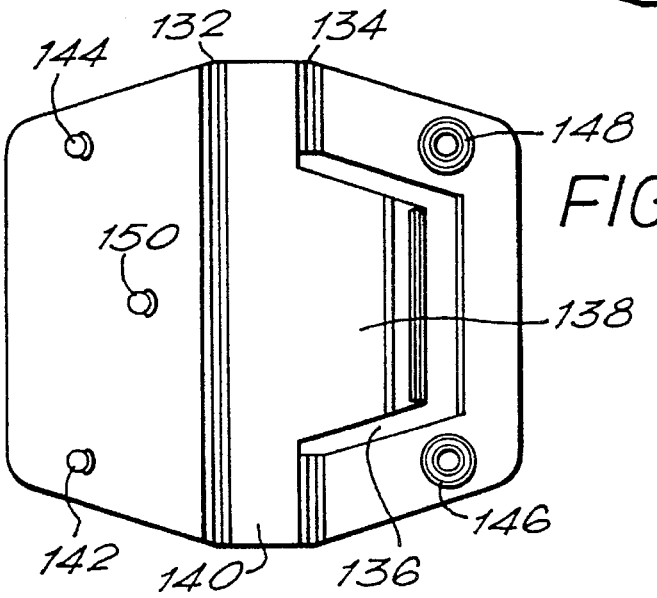
FIG.8.
FIG.9.
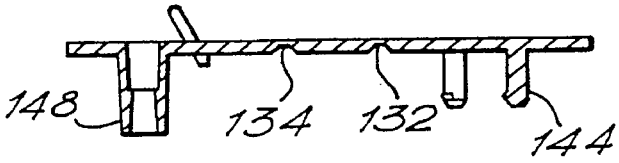
FIG.10.
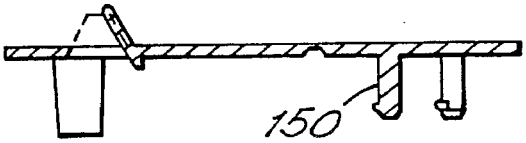
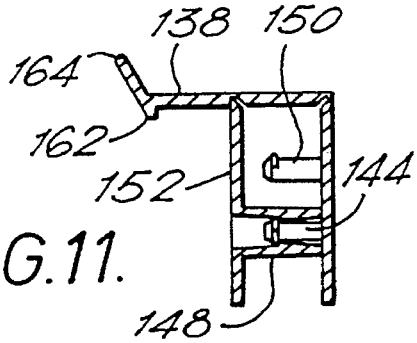
FIG.11.

FIG. 12.
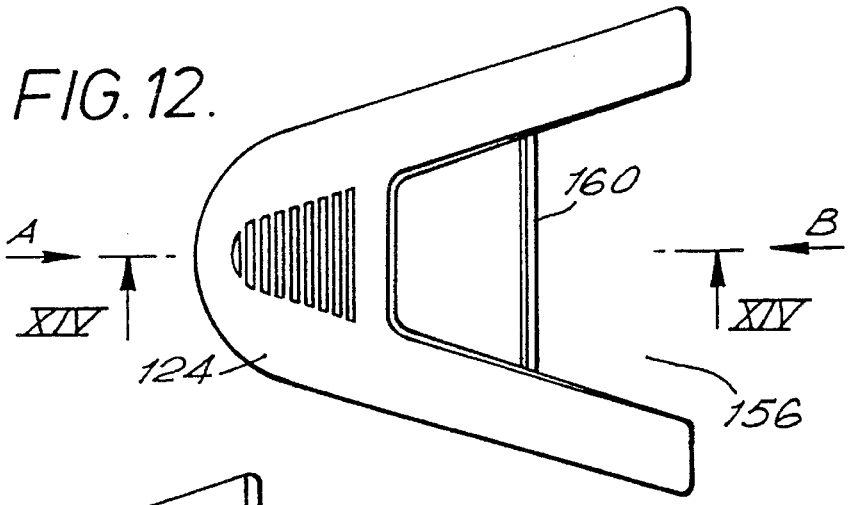
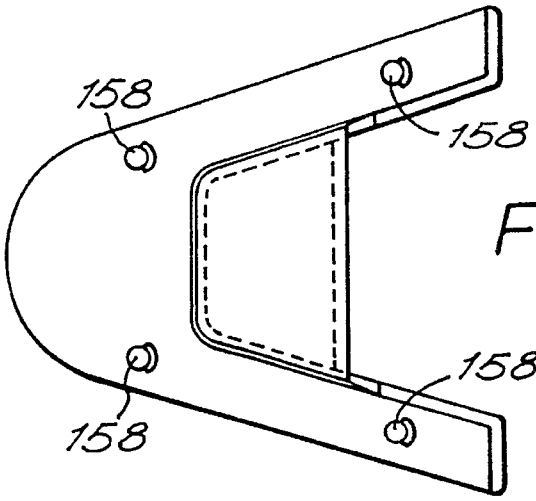
FIG. 13.
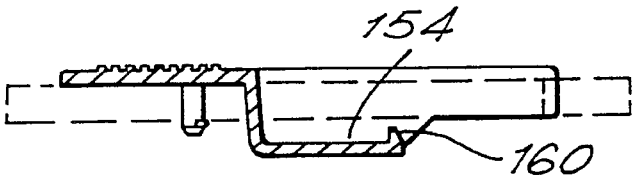
FIG. 14.
FIG. 15.
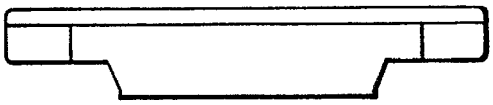
FIG. 16.
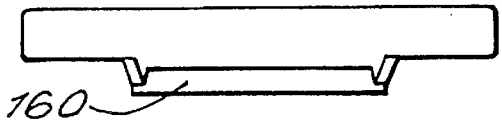

FILE BOX CLOSURE CATCH

This invention relates to a closure catch, off a type which is particularly suitable for use with box files.

Various types of closure catches for box files are known, a particularly popular type of catch being that shown in British patent no. 1,572,245, which comprises a pair of cooperating catch and latch members which are adapted to be attached to the inner faces of a wall and a lid of a file box, so as to snap together and thus hold the wall and lid in the closed position. However, this type of catch has certain disadvantages, particularly because it has to be attached to the cooperating parts of the file box by means of rivets or similar connectors, and also because its movable parts are inside the box and thus may become caught on the contents of the box.

Accordingly, the present invention seeks to provide a closure catch device particularly suitable for use with box files, which is easily attached to a box file, and in which the cooperating closure parts do not protrude unduly into the internal space of the box.

The invention further seeks to provide a closure catch which is particularly suitable for use with boxes sold in a "flat pack" form, so that they can be easily and quickly assembled by the user.

The construction of the catch may also be such that it cooperates with the structure of a "flat pack" filing box, in such a way as to hold the assembled parts in their proper relative positions.

Accordingly, a closure catch according to the invention, which is adapted to hold together, the edges of two cooperating parts of a container such as a side wall and a lid, comprises a first member which is adapted to fit onto the edge of the side wall or lid or onto a recess formed at said edge, and carries an outwardly facing projection, and a second member which is adapted to fit onto the cooperating edge of the lid or side wall and carries an inwardly facing projection adapted to snap over the outwardly facing projection of the first part.

Preferably, at least one of the members is formed as a hinged "sandwich" construction, and carries cooperating stud like formations on its inner surface, adapted to grip the material of the box to which it is attached, or to fit in cooperating apertures of the box. In addition, the cooperating edge of the box may be formed with a cut-out, whilst the catch is formed with a central body portion which fits into the cut-out, and peripheral flange portions which fit around the edges of the cut-out.

In one embodiment of the invention the other catch member comprises a generally U-shaped body portion with a pair of substantially parallel legs adapted to fit over the other, cooperating edge of the box, and an arm extending outwardly from the base of the U which carries a projection for engagement with the corresponding projection of the other part.

According to a further feature of the invention there is provided a closure catch particularly adapted for use with a box file, of the kind in which the walls comprise double layers of rigid material such as corrugated cardboard, the catch comprising a first body part of moulded plastics material, adapted to be folded into a "U-section" to engage around the edge of one wall of the box, so that the base of the U is adjacent to the edge of the wall, and carrying a protrusion which extends in the direction of the adjacent wall to which it is to be clipped to close the box; and a second body member, adapted to fit onto the said adjacent wall edge, and forming a detent member which is adapted to receive the protrusion of the first member. Preferably the second body member fits into a recess or cut-out in the said adjacent edge so as to be flush with the box surface.

The invention also extends to a box made from a folded blank, and having cooperating closure catch members attached to adjacent edges of a side-wall lid, the catch members being constructed so as to engage around the said edges to assist in maintaining the folds of the box in the assembled position.

Some embodiments of the invention will now be described by way of example, with reference to the accompanying drawings, in which FIG. 1 is a perspective view of a first type of catch in its closed position on a box;

FIG. 2 is a perspective view of a first part of the catch of FIG. 1 in a disengaged condition shown separately from the box;

FIG. 3 is a perspective view of the second part of the catch;

FIG. 6 is a schematic view of a box file for which the catch of the invention is particularly suited, shown in an open condition;

FIG. 7 is a top plan view of a second type of closure catch particularly adapted for use with a box file shown in FIGS. 20 and 21;

FIG. 8 is an underneath plan view of the catch of FIG. 7;

FIG. 9 is a cross-section on the line IX—IX of FIG. 7;

FIG. 10 is a cross-section on the line X—X of FIG. 7;

FIG. 11 is a cross-section through the catch part of FIGS. 7–10 in a "made-up" condition;

FIG. 12 is a top plan view of a second part of a box catch, adapted to cooperate with the part shown in FIGS. 7 to 10;

FIG. 13 is an underneath plan view of the catch of FIG. 12;

FIG. 14 is a vertical cross-section taken along the line XIV—XIV of FIG. 12;

FIG. 15 is an end view of the catch of FIG. 12 as viewed on the arrow A;

FIG. 16 is an end view taken from the other end, on the arrow B;

FIG. 17 is a vertical cross-section through a closed catch assembly comprising the two parts illustrated in FIGS. 7 to 16;

FIG. 18 is a vertical cross-section through a retaining clip forming part of the assembly of FIG. 17;

FIG. 19 is a front view of the clip of FIG. 18;

Figure 4:
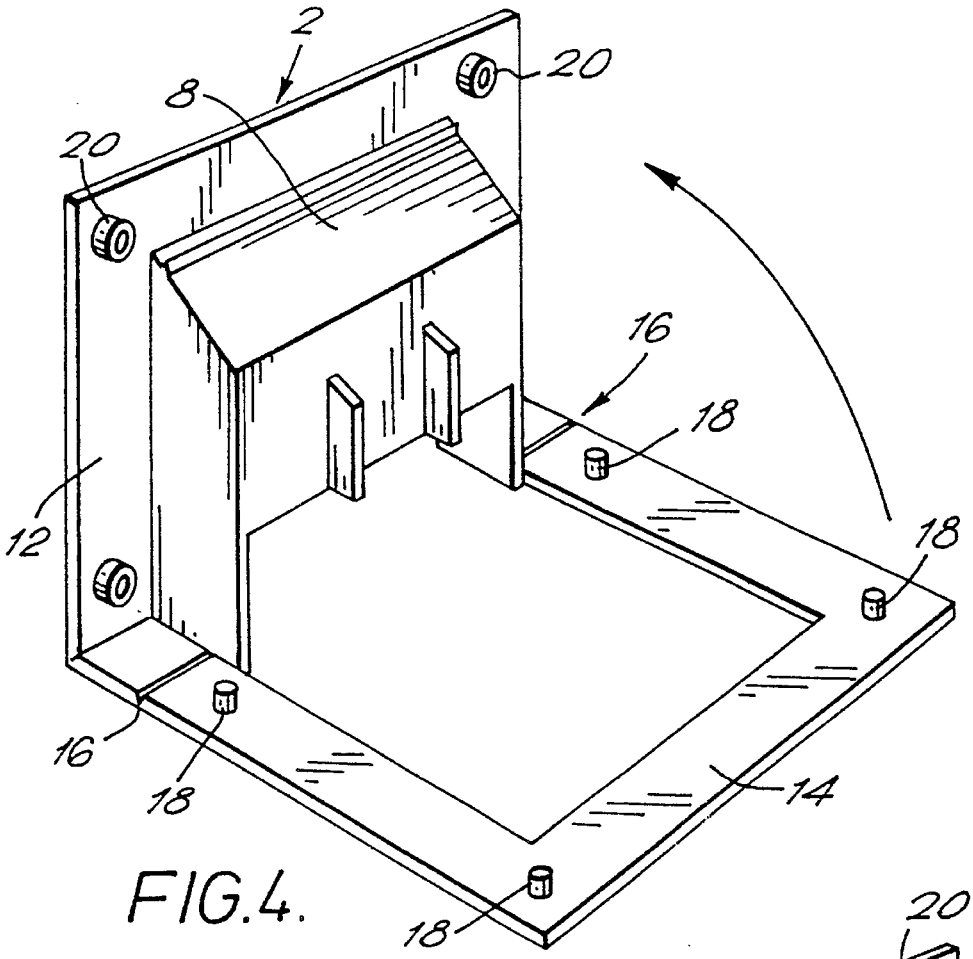
FIG. 4 is a perspective view of the first part of the catch as seen from the rear, in an "inverted" position before attachment to the box edge.

Referring to FIGS. 1 and 2, the catch is made from a fairly resilient moulded plastics material and comprises a first body member 2 which is adapted to clip over the edge of a wall 4 of a box, and a second, cooperating body part 6, which fits over the other cooperating edge of the box (not visible in FIG. 1). The body part 2 is of a "sandwich" type construction, as shown more clearly in FIGS. 4 and 5, and comprises a central body portion 8, FIG. 4, which forms a recess 10 on the outside of the box, in use. The central body portion 8 is surrounded on three sides by a flange 12, and it will be appreciated that, in order to accommodate the body of the catch, the edge of the wall of the box will be cut away so as to form a recess into which the central body part 8 fits, so that the flange 12 engages against the outer surface of the box.

An inner flange like portion 14 of the body member 2 is hinged to the main body at 16, and carries studs 18 on its inner surface, for cooperation with matching sockets 20 on the facing inner surface of the flange 12, so as to fit through the cut-out in the edge of the box. In this way, when the body parts 12 and 14 are folded together, they are securely attached to the edges of the cut-out.

As shown in FIG. 3, the other part of the catch comprises a body 24 which is generally U-shaped in cross-section, with the ends of the legs of the U carrying inwardly facing flange like projections 26 which are adapted to cooperate with a suitably positioned slot or slots in the other edge of the box, so as to hold the catch in position. The other end of the body carries a downwardly depending (as shown in the view of FIG. 3) flange 28 which terminates at its lower end in an inwardly facing projection 30. This projection 30 engages, in use, over a cooperating outwardly projecting flange 32 formed at the top edge of the recess 10 of the other catch member, as shown in FIGS. 1 and 2.

Figure 5:
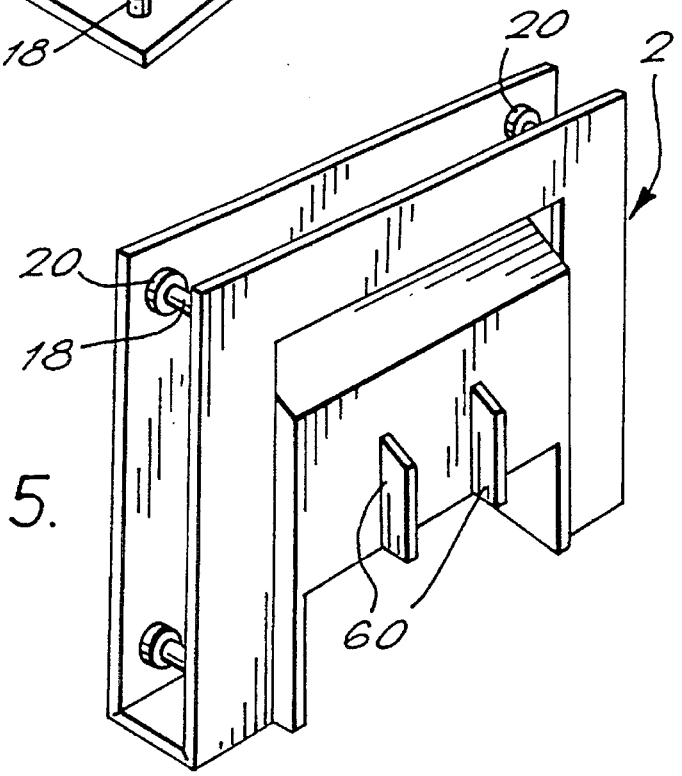
FIG. 5 is a perspective view corresponding to that of FIG. 4, but showing the catch after connection to the box edge.

In order to assist the positive inter-engagement of the two catch members, the rear surface of the central body portion 8 of the catch member 2, may be formed with a pair or parallel guide fins 60, FIG. 5, whilst a cooperating stud 62 is formed on the inner face of the other catch member 6. In this way the cooperating projections 30 and 32 are brought into proper alignment when the lid of the box is closed.

Thus it will be appreciated that the two parts of the catch member can be easily installed in position on a box, simply by providing a suitable cut-out in the edge of one wall, to receive the part 2, and a slot, in a corresponding position near the edge of the other cooperating wall, to receive the other catch part 6. As shown in FIG. 6, this makes the catch particularly suitable for use with a "prefabricated" type of flat pack box file, which comprises a pre-cut blank which is adapted to be easily folded into a predetermined shaped, by an unskilled user. The whole assembly is held in its assembled condition, by folding inwards triangular flaps 40 and 42 to form "top and bottom" walls of a box file, and then folding in end flaps 44 and 48 whose edges overlap the adjacent edges of the flaps 40 and 42, so as to hold them in the assembled condition. The cooperating edges 50 and 52 of the box, which are to be held together in the closed condition, are formed with a suitable slot and cut-out, respectively, so as to allow the two parts 6 and 2 of the catch member to be attached to them, and so that the "sandwiching" action of the two body parts hold the respective end flaps 44 and 48 of the box, firmly in position.

FIGS. 7 to 11 illustrate the main body 126 of a second type of catch in more detail. This is formed as an initially planar, injection moulded component, having a generally hexagonal outline, with two laterally extending depressions 132, 134, forming hinge regions which enable the body to be folded into a U-shaped condition, so as to embrace the edge of a box wall, as illustrated in FIG. 11. A cut-out 136, whose profile corresponds generally to the outline of the corresponding side of the catch, forms a tongue 138 which remains coplanar with the central portion 140 of the body of the catch, when the remainder is folded over.

Cross-sections through the catch body, before it is folded over, are illustrated at two different axial regions, in FIGS. 9 and 10. FIG. 9 is a cross-section taken through the off-axis line IX—IX of FIGS. 7, whilst FIG. 10 is an axial cross-section. As can be seen from the drawings, and particularly FIG. 8, the underside of the catch body is provided with a pair of protruding posts 142, 144, and corresponding sockets 146, 148, which are brought into engagement, as illustrated in FIG. 11, when the body is folded into the position in which it engages on the edge of the side wall of the filing box. It will be appreciated that corresponding apertures are formed at positions corresponding to the positions of socket 146, 148, in the side wall of the box, so as to receive the socket members and thus hold the catch in position.

A further post 150, positioned on the centreline of the catch body, and closer to the hinge region 132 than the other two posts 142, 144, is so arranged, that when the catch is in the mounted position on the edge wall of the box, it faces the aperture 152 left on the inner surface of the catch after folding the body, by the material forming the tongue 138. This post 150 is used to locate a concertina file retaining clip, as described in more detail below, with reference to FIGS. 17 to 19.

FIGS. 12 to 16 illustrate the other cooperating part 124 of the catch, which comprises a generally "V-shaped" body, having a centrally recessed portion 154 which is adapted to fit into a suitably shaped cut-out wall edge, corresponding generally to the "inner V" shape of the catch body, so as to leave an opening 156 into which the tongue 138 of the catch member 126 will extend in use, as explained in more detail below. Once again, the catch body is provided with suitable posts 158, to engage in apertures adjacent the edges of the cut-out of the box, so as to hold it in position.

As illustrated in FIGS. 12 and 16 the latter being an axial view on the arrow B of FIG. 12, the edge of the recess portion 154 is formed with an upstanding lip or flange 160, and in use, as illustrated in FIG. 17 this cooperates with a mating downturned flange 162 on the tongue 138 of the other part 126 of the catch, to hold it in a closed position. The edge of the tongue 138 also carries an upstanding flange 164 which can be engaged by the finger or thumb of an operator, so as to release the catch. It will be appreciated that in use, as a result of the complementary sloped formations 166, 168, on the faces of the mating edges 162 and 160, the catch will automatically "snap" into the closed position, when the two wall edges are brought together.

As mentioned above particularly with reference to FIG. 11, the inwardly facing post 150 on the body of the catch part 126 is adapted to receive a downwardly dependent retaining member 128, illustrated separately in FIGS. 18 and 19, having a socket member 172 which snaps pivotably onto the post 150, so that the upper edge of the rear wall 130 of a concertina file can be held in position as described below with reference to FIG. 20.

Figure 20:
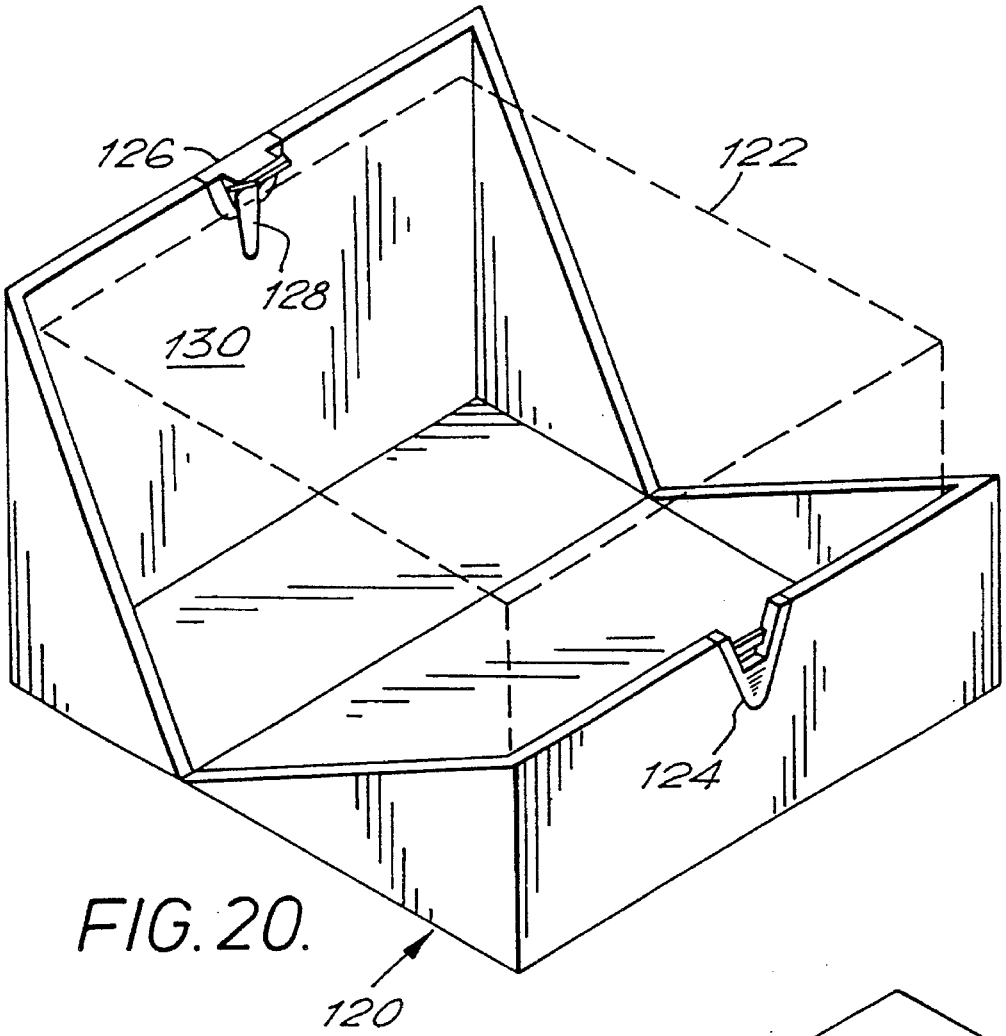
FIG. 20 is a perspective view of an open box file suitable for receiving a concertina file.
Figure 21:
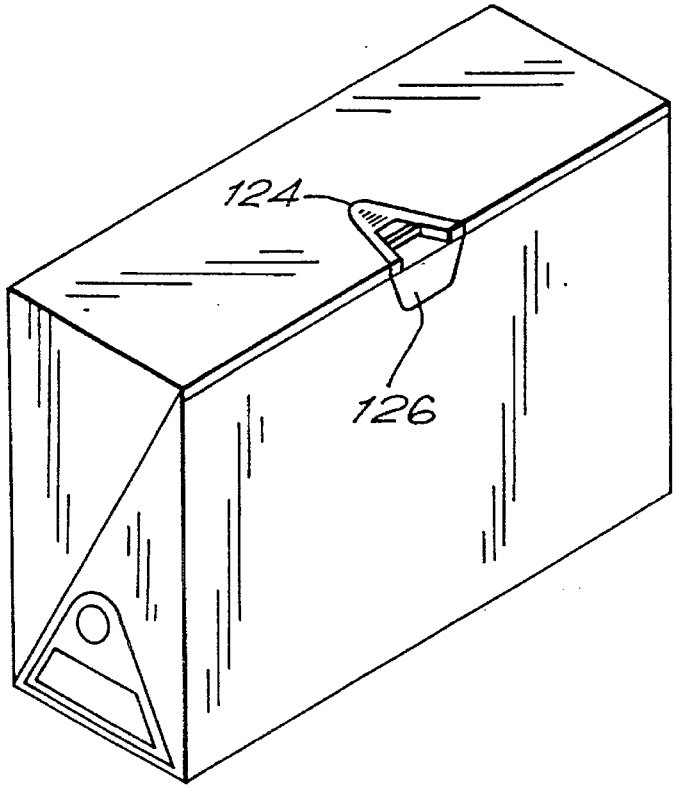
FIG. 21 is a perspective view of the box file of FIG. 20 in the closed condition.

FIG. 20 illustrates a file box utilising a catch structure of the kind illustrated in FIGS. 7 to 19, which is particularly adapted to hold a concertina file in the position indicated by the dashed outline 122, when the concertina file is extended, in the general manner described in our International patent application published under no. 90/05643. The catch comprises two parts 124, 126, which latch together to the closed position indicated in FIG. 21, and part 126 incorporates an internal dependent retaining member 128, to fit over the top edge of the rear wall 130 of the concertina file, to hold it in position in the box. Because the socket member 172 (FIG. 18) is pivotable on the post 150 (FIG. 17), the retaining member 128 can be swivelled out of engagement with the concertina file wall, when it is to be inserted or removed.

Although the catches of FIGS. 1 to 5 and 7 to 11 have been described as separate embodiments it will be appreciated that the parts are interchangeable so that (for example) the catch could comprise one body part as shown in FIGS. 2, 4 and 5 and the other as shown in FIGS. 7 to 11.

I claim:

1. A closure catch adapted to releasably hold together two cooperating parts of a box having a side wall and a lid or cover, comprising a first catch member (124) which fits onto an edge of one of the side wall and lid, and which includes an outwardly facing projection (160) of one piece therewith, and a second catch member (126) which fits over a cooperating edge of the other of the lid and side wall and includes an inwardly facing projection (162) of one piece therewith, said projection being adapted to snap over the outwardly facing projection of the first catch member; wherein said first catch member (24) is formed with a recess (154) on its outer surface and the outwardly facing projection (160) is located in said recess, the projection (162) of the second catch member being arranged to fit into said recess so that the catch is flush with an exterior of the box when it is in a closed condition, wherein one of the catch members is U-shaped to grip the corresponding edge of the box.

2. A closure catch adapted to releasably hold together two cooperating parts of a box having a side wall and a lid or cover, comprising a first catch member (124) which is adapted to fit onto an edge of the side wall or lid, and which carries an outwardly facing projection (160), and a second catch member (126) which is adapted to fit over a cooperating edge of the lid or side wall and carries an inwardly facing projection (162) adapted to snap over the outwardly facing projection of the first part; characterized in that said first catch member (24) is formed with a recess (154) on its outer surface and the outwardly facing projection (160) is located in said recess, the projection (162) of the second catch member being arranged to fit into said recess so that the catch is flush with an exterior of the box when it is in a closed condition in which at least one of the catch members is formed from a generally flat body member which is adapted to be folded into a U-shape to embrace a corresponding edge of the box and comprises cooperating projections (144, 148) on the inner surface of the U which extend through a plane of a material of the edge to engage with one another and thus secure the body in position.

3. A closure catch adapted to releasably hold together two cooperating parts of a box having a side wall and a lid or cover, comprising a first catch member (124) which is adapted to fit onto an edge of the side wall or lid, and which carries an outwardly facing projection (160), and a second catch member (126) which is adapted to fit over a cooperating edge of the lid or side wall and carries an inwardly facing projection (162) adapted to snap over the outwardly facing projection of the first part; characterized in that said first catch member (24) is formed with a recess (154) on its outer surface and the outwardly facing projection (160) is located in said recess, the projection (162) of the second catch member being arranged to fit into said recess so that the catch is flush with an exterior of the box when it is in a closed condition in which said second member comprises a generally U section body portion with a pair of substantially parallel leg members which fit around the corresponding edge of the box, and an arm (138) extending outwardly from, and parallel to, the base of the U which carries said inwardly facing projection.

4. A closure catch according to claim 1 in which said recess is tapered in a direction away from the corresponding edge, and said projection is formed with a correspondingly tapered profile so as to fit in the recess.

5. A closure catch according to claim 1 in which said second member further comprises an outwardly projecting actuating part connected to said inwardly facing projection, which can be engaged by a user to release the catch.

6. A closure catch according to claim 1 in which one of said catch members further includes an inwardly directed retaining member which is adapted to engage an edge of an insert of the box so as to retain it in position.

7. A closure catch according to claim 6 in which the retaining member is pivotally mounted on the inside surface of the catch member so as to be pivotable parallel to the plane of the corresponding wall of the box, whereby the said insert can be releasably retained in position.

8. A closure catch for holding a container lid to a container side wall comprising:

a first catch member secured to one of a lid and a side wall of an associated container, said first catch member comprising a recess and an outwardly facing projection located in said recess, a second catch member secured to another of the lid and the side wall, said second catch member comprising an inwardly facing projection that can snap over said outwardly facing projection, said inwardly facing projection fitting into said recess so that the catch is flush with an exterior surface of the associated container when the container is in a closed position, wherein at least one of said first and second catch members comprises a U shaped body having cooperating projections on an inner surface of the U shaped body, said cooperating projections extending through a plane of a material of an edge of the associated container to engage with one another and thus secure said at least one of said first and second catch members in position.

9. The closure catch of claim 8 wherein said second catch member further comprises an outwardly projecting actuating part connected to said inwardly facing projection, said outwardly projecting actuating part being engageable by a user to release the catch.

10. The closure catch of claim 8 wherein one of said first and second catch members includes an inwardly directed retaining member which engages an edge of an insert of the associated container so as to retain the insert in position.

11. A box file having a closure catch comprising:

a file body having a side wall and a lid;

a catch for holding said lid to said side wall, said catch comprising:

a first catch member secured to one of said lid and said side wall, said first catch member comprising a recess and an outwardly facing projection located in said recess, and a second catch member secured to another of said lid and said side wall, said second catch member comprising an inwardly facing projection that can snap over said outwardly facing projection, said inwardly facing projection fitting into said recess so that said catch is flush with an exterior surface of said box when said box is in a closed position, wherein said second catch member comprises a generally U-shaped section having a pair of substantially parallel leg members which fit around a corresponding edge of the box, and an arm extending outwardly from and parallel to a base of the U-shaped member, said arm carrying said inwardly facing projection.

12. The box file of claim 11 wherein said second catch member further comprises an outwardly projecting actuating part connected to said inwardly facing projection, said outwardly projecting actuating part being engageable by a user to release the catch.

13. The box file of claim 11 wherein one of said first and second catch members includes an inwardly directed retaining member which engages an edge of an insert held in said box so as to retain said insert in position.

14. The box file of claim 13 wherein said insert comprises a concertina file and said retaining member engages an edge of one end wall thereof.

* * * * *